US006634934B1

(12) United States Patent
Akaike

(10) Patent No.: US 6,634,934 B1
(45) Date of Patent: Oct. 21, 2003

(54) METHOD FOR CLEANING POLISHING TOOL, POLISHING METHOD POLISHING APPARATUS

(75) Inventor: Yoshifumi Akaike, Tokyo (JP)

(73) Assignee: Sony Corporation, Tokyo (JP)

( * ) Notice: Subject to any disclaimer, the term of this patent is extended or adjusted under 35 U.S.C. 154(b) by 37 days.

(21) Appl. No.: 09/714,653

(22) Filed: Nov. 17, 2000

(30) Foreign Application Priority Data

Nov. 19, 1999 (JP) ..... P11-330007

(51) Int. Cl.[7] ..... B24B 1/00

(52) U.S. Cl. ..... 451/56; 451/443; 451/444; 451/287

(58) Field of Search ..... 451/56, 442, 443, 451/444, 540, 548, 550, 285–289

(56) References Cited

U.S. PATENT DOCUMENTS 5,866,480 A * 2/1999 Murakami et al. ..... 438/693
6,050,884 A * 4/2000 Togawa et al. ..... 451/288
6,099,393 A * 8/2000 Katagiri et al. ..... 451/56
6,179,693 B1 * 1/2001 Beardsley et al. ..... 451/56
6,190,236 B1 * 2/2001 Drill ..... 451/41
6,227,947 B1 * 5/2001 Hu et al. ..... 451/56
6,302,772 B1 * 10/2001 Hosoki et al. ..... 451/287
6,319,105 B1 * 11/2001 Togawa et al. ..... 134/153
6,340,326 B1 * 1/2002 Kistler et al. ..... 451/286
6,488,573 B1 * 12/2002 Kobayashi et al. ..... 451/285

* cited by examiner

*Primary Examiner*—Joseph J. Hail, III
*Assistant Examiner*—David B. Thomas
(74) *Attorney, Agent, or Firm*—Rader, Fishman & Grauer PLLC; Ronald P. Kananen

(57) ABSTRACT

A method for cleaning a polishing tool capable of reliably removing deposited solidified abrasive and impurities and thereby capable of suppressing scratching of a polished object and reducing residual particles on the polished face of the polished object, comprising the steps of arranging with respect to the polishing tool a cleaning member provided with facing surfaces for forming clearances with cleaned surfaces of the polishing tool feeding a cleaning solution to clearances formed between the facing surfaces and the cleaned surfaces to form cleaning solution films, and cleaning the cleaned surfaces by rotating the polishing tool, the cleaning solution being fed to clearances between the cleaned surfaces and the facing surfaces through feed ports formed in the cleaning member and opened in the facing surfaces, and a polishing method and polishing apparatus using the same.

26 Claims, 11 Drawing Sheets

METHOD FOR CLEANING POLISHING TOOL, POLISHING METHOD POLISHING APPARATUS

BACKGROUND OF THE INVENTION

1. Field of the Invention

The present invention relates to method of cleaning a polishing tool used for flattening a variety of films, such as inter-layer insulation films, metal films, and polysilicon films, formed on, for example, a semiconductor wafer by chemical mechanical polishing and a polishing method and polishing apparatus using such a polishing tool.

2. Description of the Related Art

Along with the higher integration and use of multi-layer interconnections of semiconductor devices, the flattening of a variety of films, such as inter-layer insulation film, metal film, and polysilicon film, has become important in the process of production of a semiconductor device. As a technique for the flattening, a variety of means have been proposed, but in recent years, the chemical mechanical polishing (CMP) process is attracting attention, and a polishing apparatus for flattening by utilizing this has been developed.

An example of a polishing apparatus using the conventional CMP process is shown in FIG. 1. A polishing apparatus 301 shown in FIG. 1 has a main shaft spindle 303 for rotating a polishing tool 302 and a rotating table 304 for holding a wafer W. The table 304 is rotatably mounted on a slider 306 provided moveably in an X-axial direction along a rail 305 and rotated by a rotation driving means constituted by, for example, a motor, a pulley, and a belt. The main shaft spindle 303 is held moveably in a Z-axial direction and positioned at a target position in the Z-axial direction by a not illustrated drive mechanism.

In the polishing apparatus 301 having the above constitution, first, the wafer W is rotated at a predetermined speed, and a slurry is continuously fed as an abrasive from a slurry feeder (not illustrated) onto the wafer W. The slurry is obtained by mixing a very fine polishing abrasive, for example, silicon oxide, with a liquid such as an aqueous solution of potassium hydroxide. Next, the polishing tool 302 is rotated at a predetermined speed to position the wafer W and the polishing tool 302 in the X-axial and Z-axial directions so that the polishing tool 302 is located at a position where it contacts an outer circumferential portion of the wafer W. In this state, a surface of the wafer W and a polishing surface of the polishing tool 302 are in substantially a parallel state.

The polishing tool 302 is positioned in the Z-axial direction so as to obtain a predetermined depth of cut with respect to the wafer W. By this, a predetermined polishing pressure is generated between the polishing tool 302 and the wafer W. By movement of the wafer W in the X-axial direction with a predetermined speed pattern and by movement of the contact position between the polishing surface of the polishing tool 302 and the wafer W in this state, the entire surface of the wafer W is polished and the wafer W is flattened.

In the polishing apparatus 301, at the time of discharge of the slurry onto the wafer W and the polishing of the wafer W, the slurry sometimes deposits on the polishing tool 302 and the periphery of its attachment portion and then adheres and solidifies. When the solidified slurry or the like drops from the polishing tool 302 during the polishing and enters into the space between a polished surface of the wafer W and the polishing surface of the polishing tool 302, it acts as a giant abrasive. When polishing pressure is added to the polished surface of the wafer W through the polishing tool 302 and a polishing operation is carried out in this state, it will scratch the polished surface of the wafer W or cause particles to deposit on it. If more than a prescribed number of scratches or residual particles are generated on the polished surface of the wafer W after the polishing, the wafer W ends up becoming a defect.

Further, the polishing tool 302 of the polishing apparatus having the above constitution is formed by an independent foam member, for example, polyurethane foam. The polishing surface of the polishing tool 302 made of such a material is susceptible to a so-called clogged state where the reaction product generated at the time of polishing and the flaked off substance forming the polishing tool 302 enter into the foam member. When in the clogged state, stable polishing cannot be carried out, so it is necessary to dress the tool to remove the surface layer of the polishing surface of the polishing tool 302 in the clogged state to condition the polishing surface of the polishing tool 302. The tool is dressed by shaving the polishing surface of the polishing tool 302 by a dresser with, for example, a diamond abrasive fixed thereto. When dressing the tool, part of the substance constituting the polishing tool 302 flaked from the polishing tool 302 and part of the substance constituting the dresser flaked from the dresser sometimes deposit on the polishing tool 302. The deposited substances sometimes become a cause of scratching the wafer surface.

In order to prevent the scratching of the wafer surface mentioned above, conventionally, for example, pure water was discharged onto the polished surface of the wafer W before the polishing, the polishing tool 302 was moved downward in the Z-axial direction while rotating the same and brought into contact with the pure water layer resident on the wafer W, and the slurry and impurities deposited on the polishing tool 302 were thereby removed to a certain extent.

Further, for example, as shown in FIG. 2, a cleaning use spray nozzle 307 having discharge ports at several positions is disposed in the vicinity of the position just under the polishing tool 302 on the slider 306 moveable in the X-axial direction. The spray nozzle 307 is moved downward up to that vicinity of the polishing tool 302 while rotating immediately before the polishing operation or while standing by for the operation. By cleaning the surface of the polishing tool 302 by discharging pure water from the spray nozzle 307 at a point of time when the polishing tool 302 reaches a predetermined height, the slurry and the impurities deposited on the polishing tool 302 have been removed to a certain extent.

However, there are also cases where they deposit on the outer circumferential surface of the polishing tool 302 or the periphery of the attachment portion of the polishing tool 302 and adhere and solidify. It was difficult to sufficiently remove these solidified impurities by the methods mentioned above or the solidified slurry and impurities deposited on the polishing tool 302 were insufficiently removed in some cases.

Further, there is also a method of disposing a cleaning use brush directly contacting the polishing tool 302 to clean the polishing tool 302, but there is the disadvantage that the solidified slurry and impurities remained inside or outside the cleaning use brush. These solidified slurry and impurities sometimes again are deposited on the polishing tool 302 at the time of the next cleaning and on. Further, if the cleaning use brush is brought into direct contact with the surface of the polishing tool 302, it changes the shape of the polishing surface of the polishing tool 302 or the cleaning use brush gradually deteriorates. Further, it is advantageous for improving the polishing efficiency if an adequate amount of slurry is provided at the surface of the polishing tool 302, but there is also the disadvantage that if the cleaning use brush is brought into direct contact with the surface of the polishing tool 302 to clean the same, even the useful slurry provided at the polishing tool 302 was scraped off.

SUMMARY OF THE INVENTION

An object of the present invention is to provide a method for cleaning a polishing tool capable of reliably removing deposited solidified abrasive and impurities.

Another object of the present invention is to provide a polishing method capable of suppressing scratching of a polished object and capable of reducing residual particles on the polished surface of the polished object.

Still another object of the present invention is to provide a polishing apparatus capable of suppressing scratching of a polished object and capable of reducing residual particles on the polished surface of the polished object.

According to one aspect of the present invention, there is provided a cleaning method of a polishing tool for cleaning a rotatably held polishing tool, comprising: arranging with respect to the polishing tool a cleaning member having a facing surface forming a clearance with a cleaned surface of said polishing tool, feeding a cleaning solution to the clearance to form a cleaning solution film, and rotating the polishing tool to clean the cleaned surface.

According to a second aspect of the present invention, there is provided a cleaning method of a polishing tool for cleaning a rotatably held polishing tool, comprising: positioning a correction tool for correcting the polishing surface at a position enabling contact with the polishing surface of the polishing tool, positioning a cleaning member having a facing surface for forming a clearance with at least part of the polishing surface of the polishing tool, feeding a cleaning solution to the clearance to form a cleaning solution film, and rotating the polishing tool to correct the polishing surface while cleaning the cleaned surface.

According to a third aspect of the present invention, there is provided a polishing method for flattening a polished object by making the polishing surface of the rotating polishing tool face the polished surface of the rotating polished object and relatively moving the polished object and the polishing tool along a predetermined plane, comprising: positioning the polishing tool at a predetermined position with respect to a cleaning member provided with a facing surface for forming a clearance with the cleaning face of the polishing tool, feeding a cleaning solution to the clearance formed between the facing surface and the cleaned surface to form a cleaning solution film, rotating the polishing tool to clean the cleaned surface and polishing the polished object by using the cleaned polishing tool.

According to a fourth aspect of the present invention, there is provided a polishing apparatus comprising: a polishing means for flattening a polished object by a rotating polishing tool and a polishing tool cleaning means for cleaning the surface of the polishing tool, wherein the polishing tool cleaning means has a cleaning member having a facing surface for forming a clearance for forming a film of a cleaning solution with the cleaned surface of the rotating polishing tool and a cleaning solution feeding means for feeding the cleaning solution to the clearance. In the present invention, when the cleaning solution is fed to the clearance formed between the cleaned surface of the polishing tool and the facing surface of the cleaning use member, a film of the cleaning solution is formed between the cleaned surface and the facing surface. When the polishing tool is rotated in this state, the cleaned surface of the polishing tool and the facing surface of the cleaning use member relatively move, a shearing force acts upon the film of the cleaning solution due to the resistance between the cleaned surface of the polishing tool and the facing surface of the cleaning use member, and the shearing force acting upon this film of cleaning solution removes the solidified abrasive and impurities deposited on the cleaned surface of the polishing tool with a high efficiency. Further, by making the facing surface of the cleaning use member partially face the cleaned surface of the polishing tool, the solidified abrasive and impurities removed from the cleaned surface of the polishing tool and contained in the cleaning solution are discharged to the outside together with the cleaning solution from the clearance formed between the cleaned surface of the polishing tool and the facing surface of the cleaning use member and will not deposit again to the cleaned surface of the polishing tool. Further, in the present invention, by simultaneously correcting the polishing surface of the polishing tool by the correction tool together with the cleaning of the polishing tool, the cleaning solution deposited on the polishing surface of the polishing tool also cleans the correction tool. Further, in the present invention, by feeding the cleaning solution to the clearance formed between the cleaned surface of the polishing tool and the facing surface of the cleaning use member through the feed ports formed in the facing surface of the cleaning use member, a sufficient amount of the cleaning solution is stably fed to the clearance formed between the cleaned surface of the polishing tool and the facing surface of the cleaning use member and the film of the cleaning solution is stably formed.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
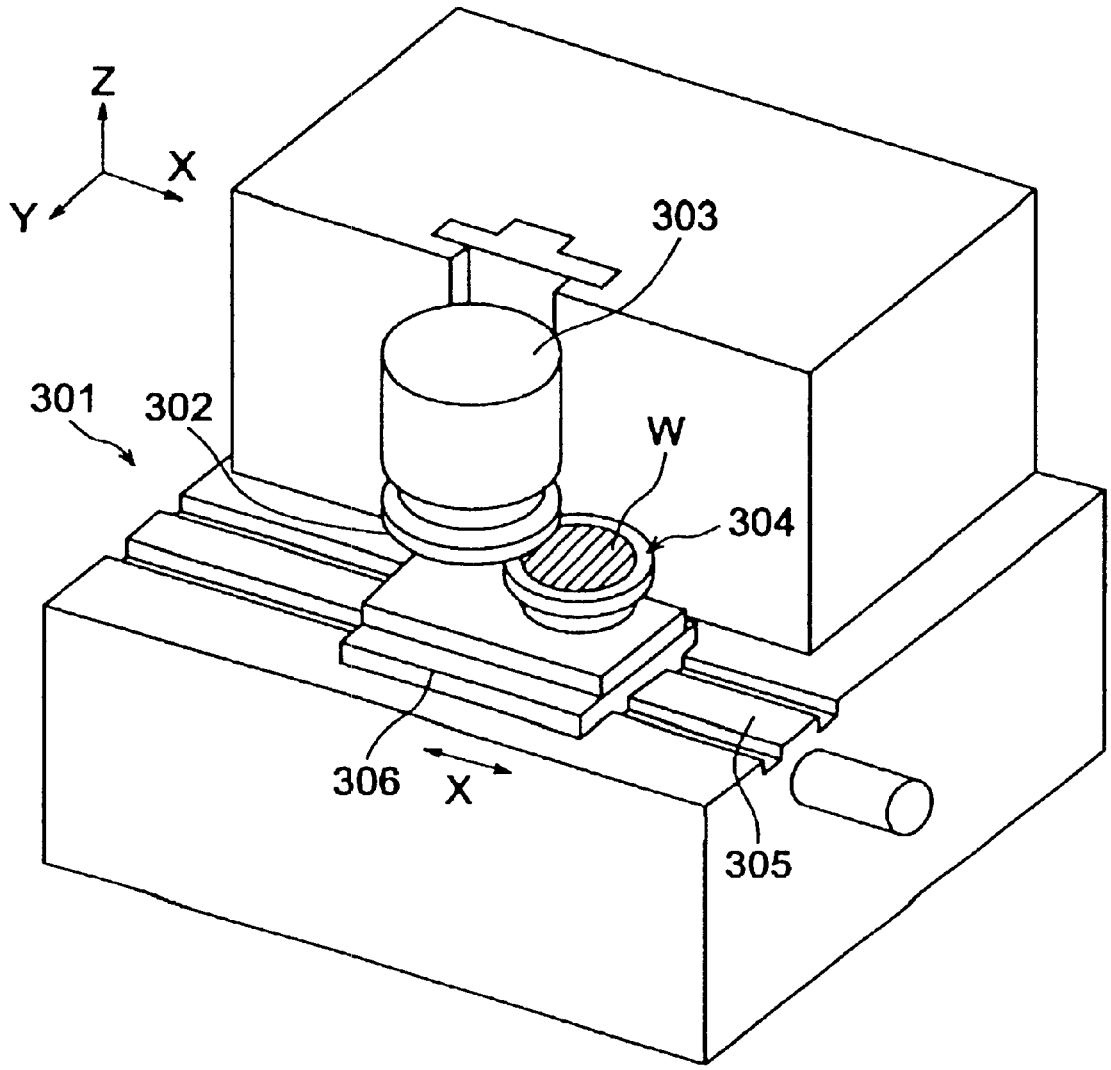
FIG. 1 is a view of an example of the configuration of a polishing apparatus.
Figure 2:
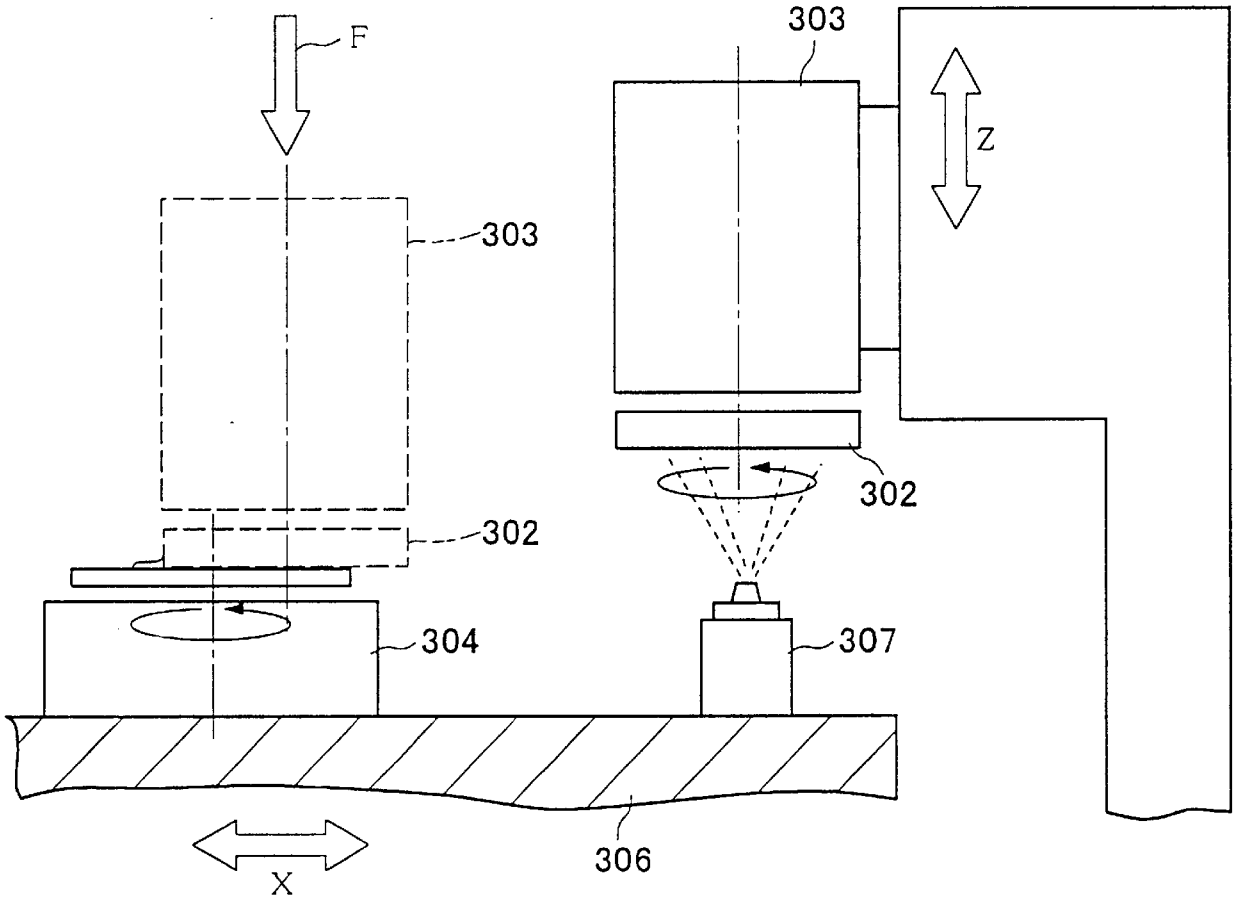
FIG. 2 is a view of an example of a method for cleaning a polishing tool of the related art.
Figure 3:
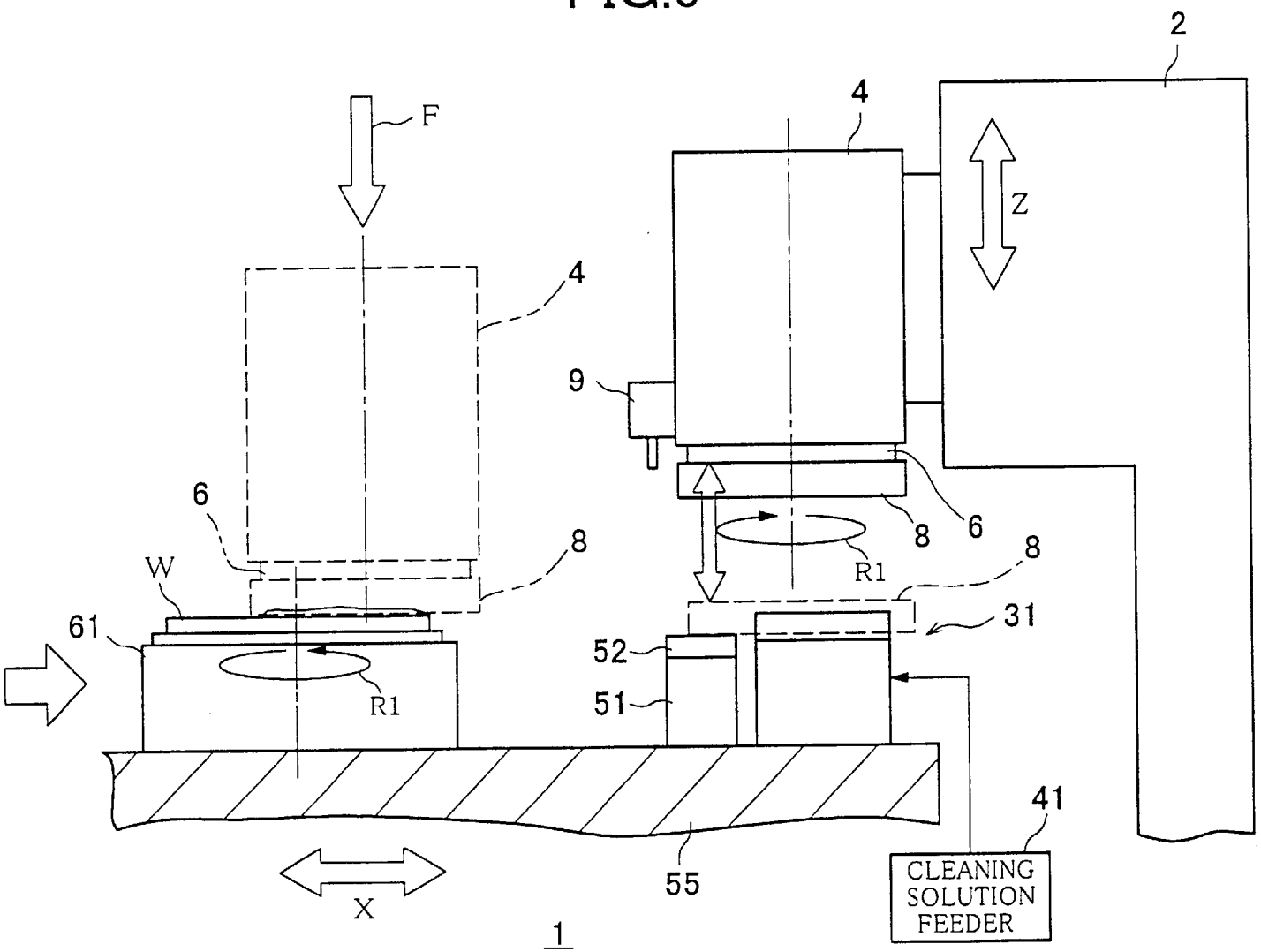
FIG. 3 is a view of the configuration of a polishing apparatus according to an embodiment of the present invention.

Below, an embodiment of the present invention will be explained in detail by referring to the drawings. FIG. 3 is a view of the configuration of the polishing apparatus according to an embodiment of the present invention.

A polishing apparatus 1 shown in FIG. 3 has a polishing head 4 held at a gate type column 2 vertically arranged on a reference surface (not illustrated), a polishing tool 8 rotatably held at the polishing head 4, an X-axis table 55 provided beneath the polishing tool 8 in the Z-axial direction, a rotating table 61 for holding the wafer W provided on the X-axis table 55, a polishing tool cleaning portion 31 provided on the X-axis table 55, and a polishing tool correction device 51 provided on the X-axis table 55.

The column 2 contains a Z-axis movement mechanism (not illustrated) for moving the polishing head 4 for holding the polishing tool 8 in the Z-axial direction, that is, the direction wherein the polishing tool 8 faces the wafer W, and it can move and position the polishing head 4 at any position in the Z-axial direction. Note that the Z-axis movement mechanism (not illustrated) is the moving means for relatively moving the polishing tool 8 in the direction facing the wafer W being polished.

The polishing head 4 contains a holding device for rotatably holding the main shaft 6 and a main shaft motor for rotating the main shaft 6. The polishing tool 8 is fixed and fastened at the bottom end of the main shaft 6. By this, the polishing head 4 rotates the polishing tool 8 at an intended speed. Further, the polishing head 4 is provided with a slurry feed nozzle 9 serving as the abrasive feeding means for feeding the slurry serving as the abrasive onto the wafer W serving as the polished object. This slurry feed nozzle 9 can feed the slurry fed from the slurry feeder (not illustrated) onto the polished face of the wafer W.

The slurry fed from the slurry feed nozzle 9 is not particularly limited, but for an oxide film, use can be made of, for example, one obtained by suspending a silica-based fumed silica and high purity ceria in an aqueous solution containing potassium hydroxide as the base or, for an interconnection metal, use can be made of one obtained by mixing a solvent having oxidizing power into a polishing solution containing alumina as the polishing abrasive. Further, the slurry feed nozzle 9 can also feed pure water onto the wafer W.

The polishing tool 8 is made of, for example, a cylindrical body and is provided with a ring-like polishing surface on one end. As the polishing tool 8, use is made of, for example, one formed by an independent foam member made of a resin such as polyurethane foam. The rotating table 61 rotatably holds the wafer W and rotates the wafer W at the intended speed by the included driving means. The rotation axis of the rotating table 61 and the rotation axis of the polishing head 4 are substantially parallel, while the polished face of the wafer W and the polishing surface of the polishing tool 8 are parallel. The rotating table 61 is provided on the X-axis table 55. This X-axis table 55 moves the polished face of the wafer W in the X-axial direction. Namely, the X-axis table 55 is the moving means for relatively moving the wafer W along a horizontal face with respect to the polishing tool 8.

The wafer W is fixed and fastened at the rotating table 61 by a chucking means such as vacuum chucking. A variety of films, such as an inter-layer insulation film, metal film, or polysilicon film, are formed on a substrate made of, for example, silicon. These variety of films are flattened by the polishing apparatus of the present embodiment. Note that, the polishing means of the present invention is constituted by the polishing head 4, Z-axis movement mechanism, polishing tool 8, rotating table 61, X-axis table 55, and so on.

The polishing tool cleaning portion 31 is provided on the X-axis table 55 and cleans the surface of the polishing tool 8 by the cleaning solution fed from a cleaning solution feeder 41. This polishing tool cleaning portion 31 is able to move to a predetermined position beneath the polishing tool 8 by the movement of the X-axis table 55. Further, the polishing tool 8 is positioned at a predetermined position in the Z-axial direction by the Z-axis movement mechanism (not illustrated) contained in the column 2 with respect to the polishing tool cleaning portion 31 positioned at a predetermined position beneath the polishing tool 8.

The polishing tool correction device 51 is provided adjoining the polishing tool cleaning portion 31 on the X-axis table 55. This polishing tool correction device 51 is provided at its top end with a correction tool 52 for correcting the polishing surface of the polishing tool 8 and corrects the polishing surface of the polishing tool 8 by bringing the polishing surface of the rotating polishing tool 8 into contact with the correction face of the correction tool 52. The correction face of the correction tool 52 is arranged along, for example, the horizontal face. By bringing the polishing surface of the rotating polishing tool 8 into contact with this, the polishing surface of the polishing tool 8 is corrected. As the correction tool 52, use can be made of, for example, one forming a polishing surface by roughness on one face of a disk made of ceramic or one obtained by electrically fixing a diamond abrasive to one face of a disk made of stainless steel.

The correction of the polishing surface of the polishing tool 8 includes, for example, truing for shaping the polishing surface of the polishing tool 8 to its true shape and dimensions and dressing for correcting the polishing surface of the polishing tool 8 to a surface state having good cutting. The truing is mainly carried out at the time of replacement of the polishing tool 8 or in a case where the polishing tool 8 is not used for a long period of time. A relatively large amount of removal of, for example, about 0.1 mm to 0.3 mm becomes necessary for completely removing the initial shaping error or assembly error of the polishing tool 8 on the machine. The dressing is carried out, for example, for every wafer W or for every 10 wafers, for every 25 wafers, or for every 100 wafers. The layer causing clogging or abrasion of the polishing surface of the polishing tool 8 is removed with an amount of removal of about 2 to 10 $\mu$m.

Figure 4:
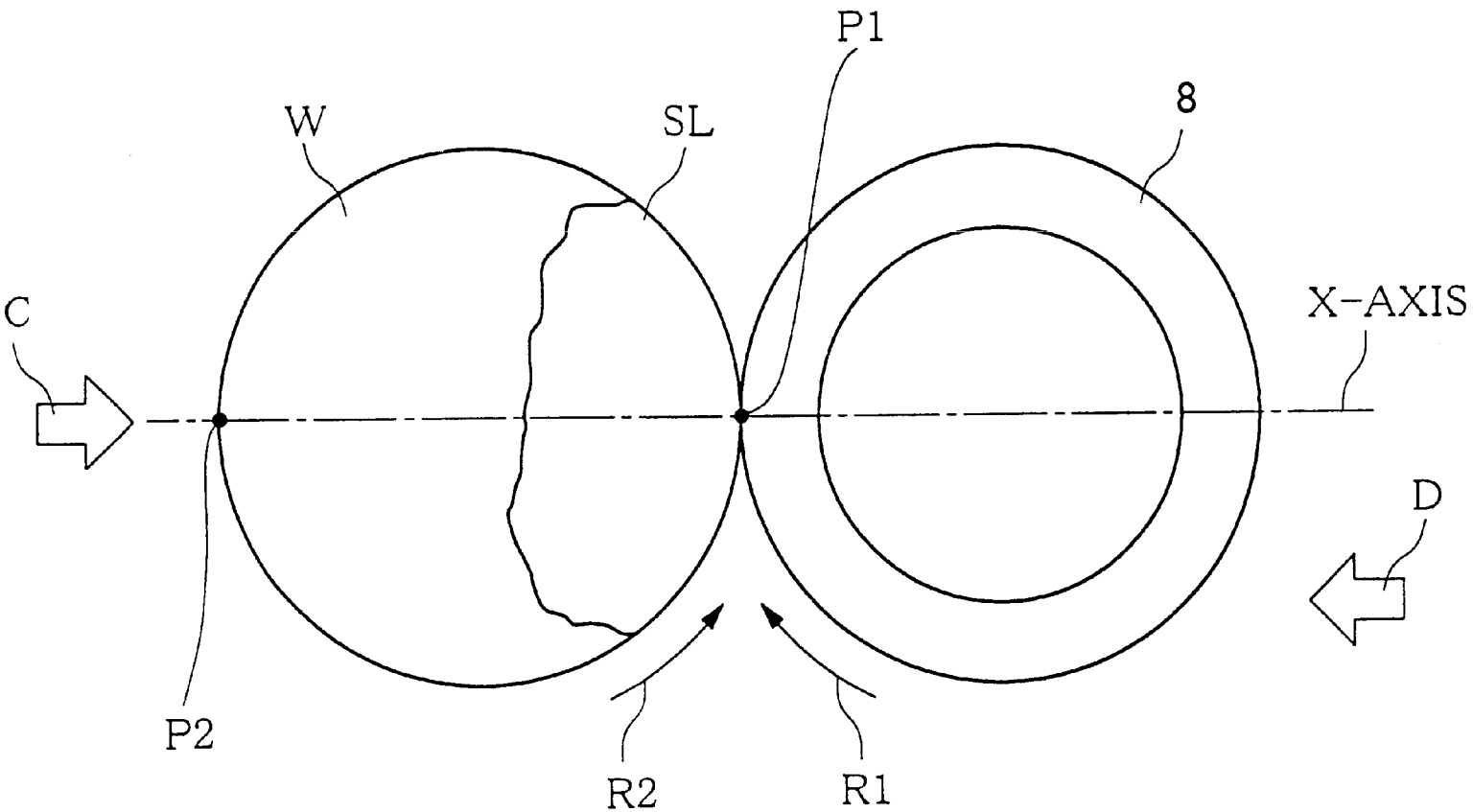
FIG. 4 is a view of the relationship between a wafer and a polishing tool at the time of polishing.

Next, an explanation will be given of a basic polishing operation of the polishing apparatus. FIG. 4 is a view of an example of the relationship between the wafer W and the polishing tool 8 at the time of polishing by the polishing apparatus 1. First, a rear surface of the wafer W is fixed to the top surface of the rotating table 61, the rotating table 61 is made to rotate, and, as shown in FIG. 4, a slurry SL is discharged onto the wafer W at a constant rate. Note that the slurry SL is constantly supplemented in exactly the required amount at the time of polishing as well.

The polishing tool 8 held at the polishing head 4 is then moved downward in the Z-axial direction, whereby, as shown in FIG. 4, a state where a polishing start point P1 of an outer circumferential portion of the wafer W and the outer circumferential portion of the polishing tool 8 are overlapped is exhibited. From this state, the wafer W and the polishing surface of the polishing tool 8 are brought into contact with each other while rotating in a substantially parallel state to start the polishing while applying a polishing pressure F shown in FIG. 3 to a direction vertical to the polished face of the wafer W. A rotation direction R2 of the wafer W and a rotation direction R1 of the polishing tool 8 are reverse to each other. The wafer W is moved from the polishing start point P1 in a direction indicated by an arrow C wherein an overlap of the wafer W and the polishing tool 8 relatively increases with a predetermined speed pattern. By this, the polishing of the polished face of the wafer W is advanced toward a direction indicated by an arrow D. When the outer circumferential portion of the polishing tool 8 moves up to a polishing end point P2 of the wafer W, the polishing of the polished face of the wafer W is terminated.

Figure 5:
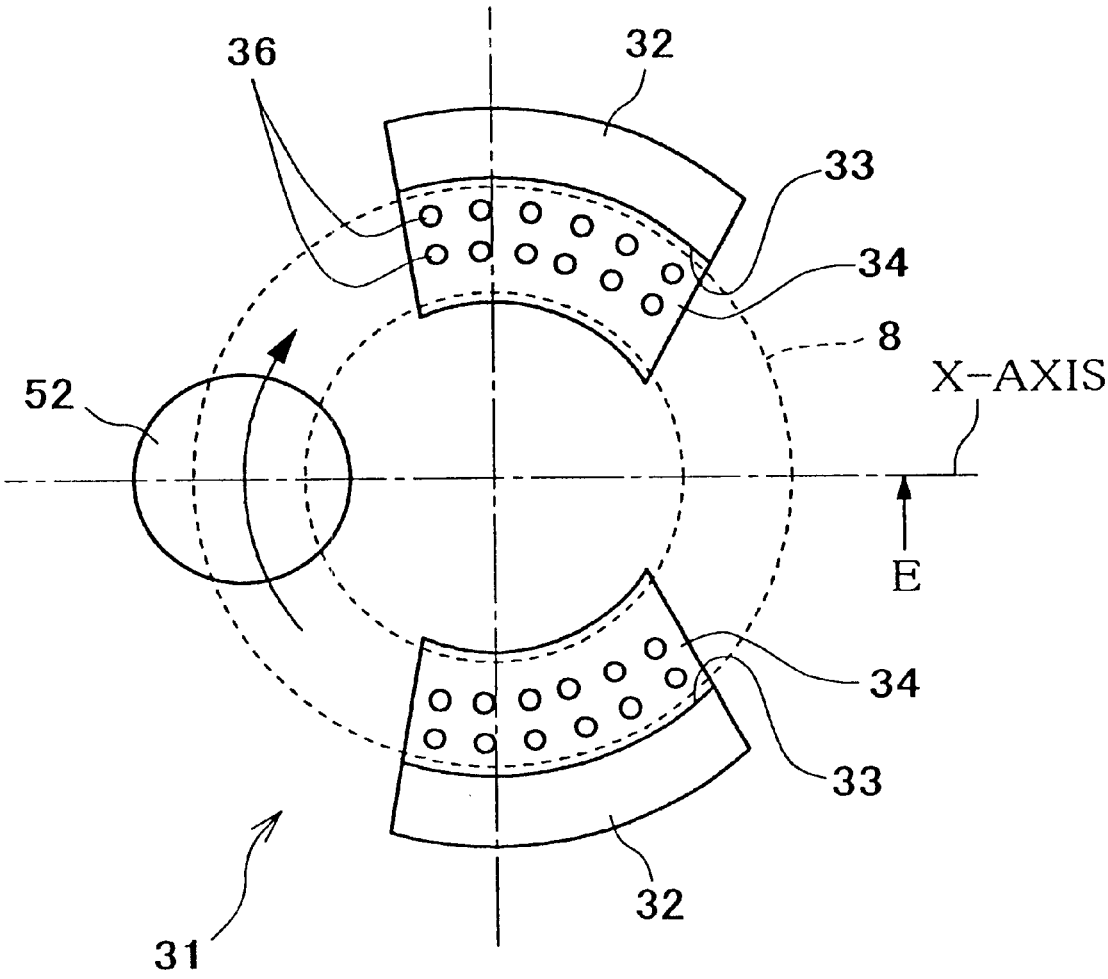
FIG. 5 is a view of a polishing tool cleaning portion 31 of FIG. 3 seen from above (Z-axial direction)
Figure 6:
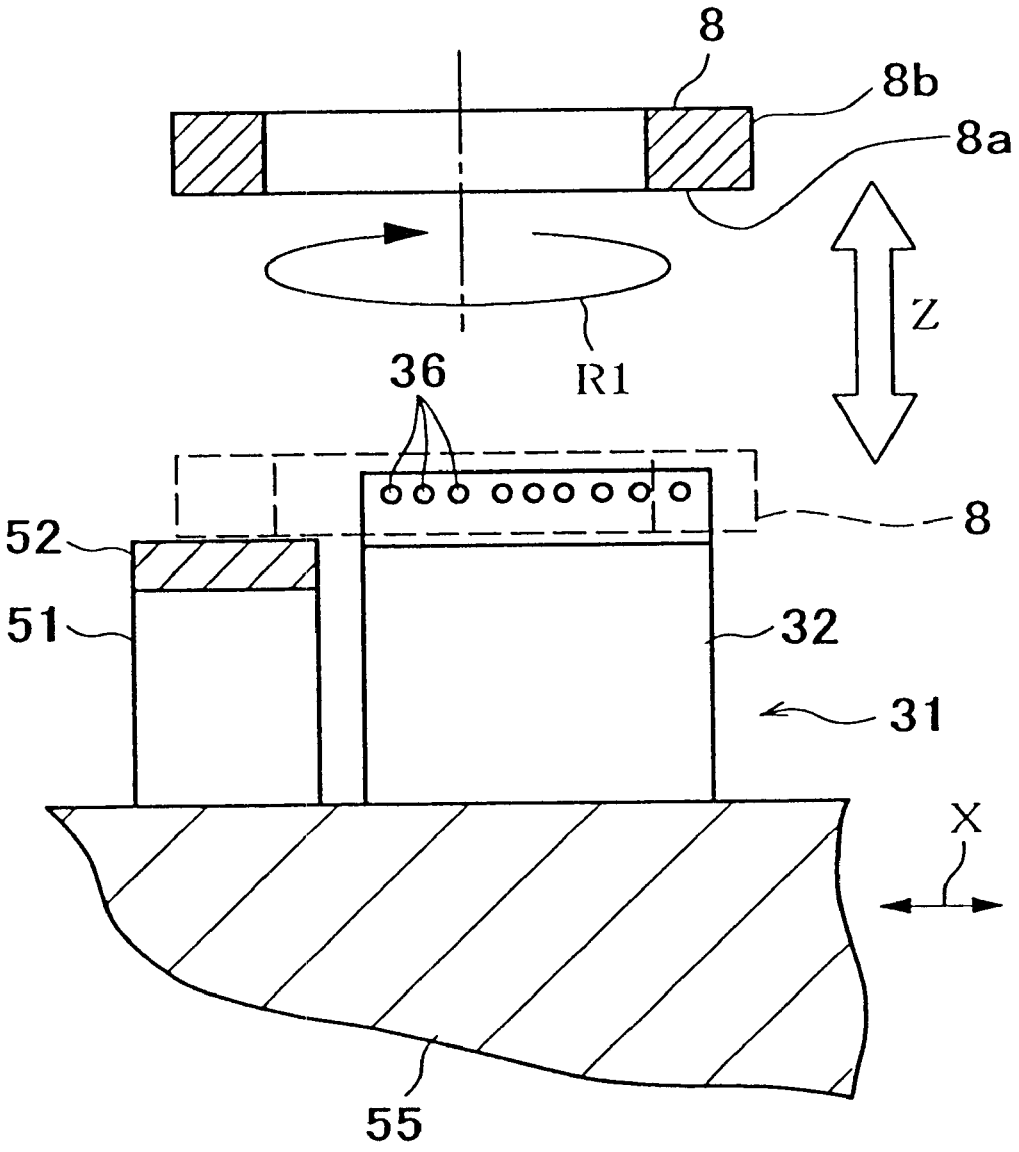
FIG. 6 is a view of the polishing tool cleaning portion 31 seen from a direction indicated by an arrow B in FIG. 5.

Next, an explanation will be made of the concrete configuration of the polishing tool cleaning portion 31. FIG. 5 is a view of the polishing tool cleaning portion 31 of FIG. 3 seen from above (Z-axial direction); FIG. 6 is a view of the polishing tool cleaning portion 31 seen from a direction indicated by an arrow E in FIG. 5; and FIG. 7 is a side view of the polishing tool cleaning portion 31 seen from a dressing device 51 side.

Figure 7:
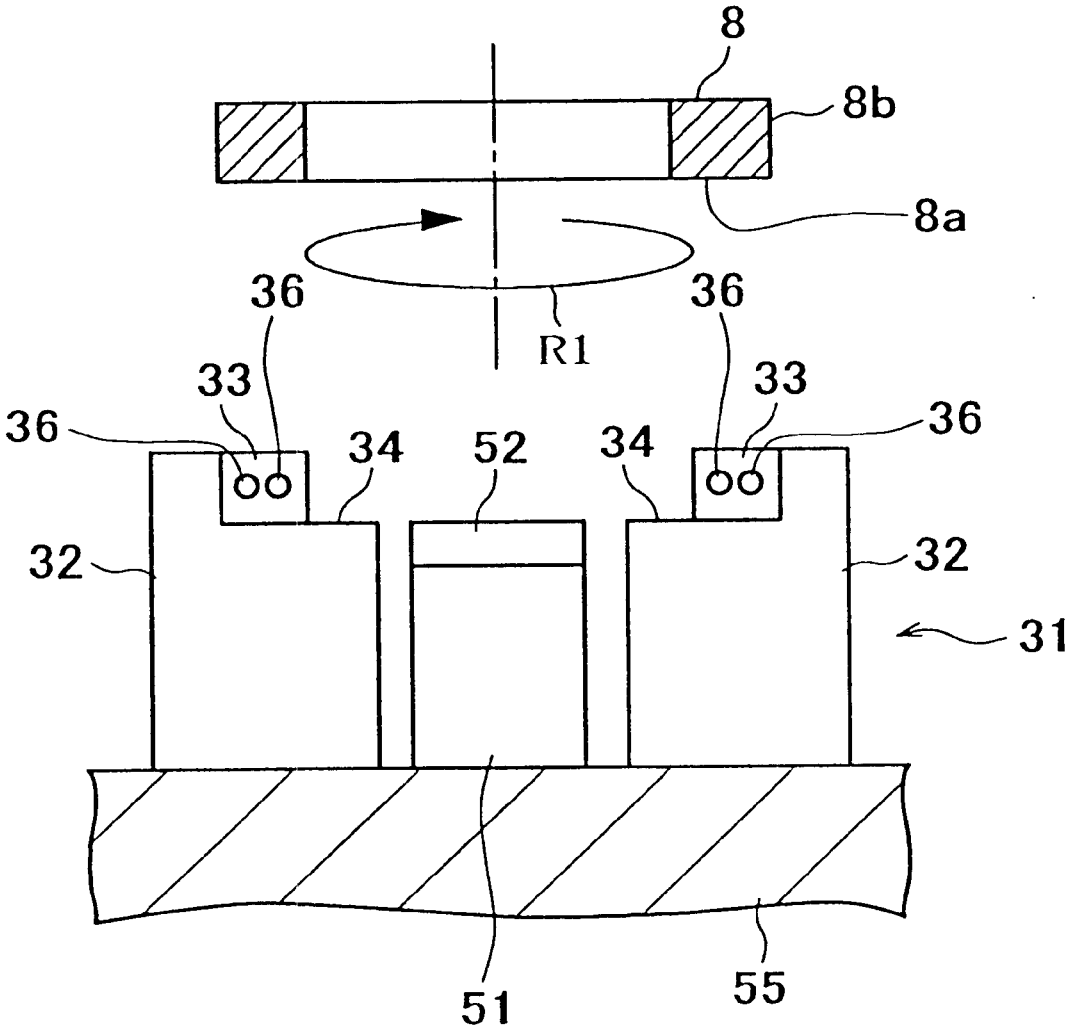
FIG. 7 is a side view of the polishing tool cleaning portion 31 seen from a polishing tool correction device 51 side.

As shown in FIG. 5 to FIG. 7, the polishing tool cleaning portion 31 has a plurality of (two) cleaning members 32. These cleaning members 32 are arranged at symmetric positions with respect to the X-axis. Further, the cleaning member 32 is provided with a facing surface 34 facing a polishing surface 8*a* of the polishing tool 8 and a facing surface 33 facing an outer circumferential surface 8*b* of the polishing tool 8. Note that, it is the state where the polishing tool 8 is positioned at a predetermined position with respect to the polishing tool cleaning portion 31, that is, the X-axis table 55 is positioned at a predetermined position in the X-axial direction and the polishing tool 8 is positioned at a predetermined position in the Z-axial direction as indicated by a dotted line in FIG. 6 that the facing surfaces 34 and 33 of the cleaning member 32 face the polishing surface 8*a* and the outer circumferential surface 8*b* of the polishing tool 8.

The facing surfaces 34 and 33 of the cleaning member 32 are formed so as to partially cover the polishing surface 8*a* and the outer circumferential surface 8*b* of the polishing tool 8. Predetermined clearances are formed between the facing surfaces 34 and 33 of the cleaning member 32 and the polishing surface 8*a* and the outer circumferential surface 8*b* of the polishing tool 8. The clearances between the facing surfaces 34 and 33 of the cleaning member 32 and the polishing surface 8*a* and the outer circumferential surface 8*b* of the polishing tool 8 are relatively fine clearances of, for example, about 2 mm or less.

The facing surface 34 of the cleaning member 32 is a flat surface substantially parallel to the polishing surface 8*a* of the polishing tool 8, while the facing surface 33 is a curved surface curved along the outer circumferential surface 8*b* of the polishing tool 8. Further, preferably the facing surfaces 33 and 34 are formed as rough surfaces by, for example, etching.

Note that the outer circumferential surface 8*b* of the polishing tool 8 has an arc shape, so the facing surface 33 is also an arc or a shape approximate to an arc. Further, the facing surface 34 and the facing surface 33 of the cleaning member 32 have a vertical position relationship and continue from each other. Further, the facing surface 34 of the cleaning member 32 has a width substantially equal to the width of the polishing surface 8*a* of the polishing tool 8 in a radial direction, and the facing surface 33 has a height substantially equal to the height of the polishing tool 8 in the direction of the rotation axis.

The cleaning member 32 is formed with a plurality of cleaning solution feed ports 36. These cleaning solution feed ports 36 are opened in the facing surface 34 and the facing surface 33. The cleaning solution feed ports 36 are connected to the cleaning solution feeder 41. The cleaning solution fed from the cleaning solution feeder 41 is discharged from the facing surface 34 and the facing surface 33 through the cleaning solution feed ports 36. The number of the cleaning solution feed ports 36 is not particularly limited, but preferably a certain number of cleaning solution feed ports are arranged in a dispersed manner in the facing surface 34 and the facing surface 33 from a viewpoint of forming a stable film of cleaning solution between the facing surface 34 and the facing surface 33 and the polishing surface 8*a* and the outer circumferential surface 8*b* of the polishing tool 8. Note that the cleaning solution feeder 41 feeds, for example, pure water as the cleaning solution.

On the other hand, in an area on the X-axis table 55 where the two cleaning members 32 are not arranged, the correction device 51 is arranged. The correction tool 52 of the correction device 51 is arranged at a position where its correction face can contact the polishing surface 8*a* of the polishing tool 8 in a state where the polishing tool 8 is positioned at a predetermined position with respect to the polishing tool cleaning portion 31.

Figure 8:
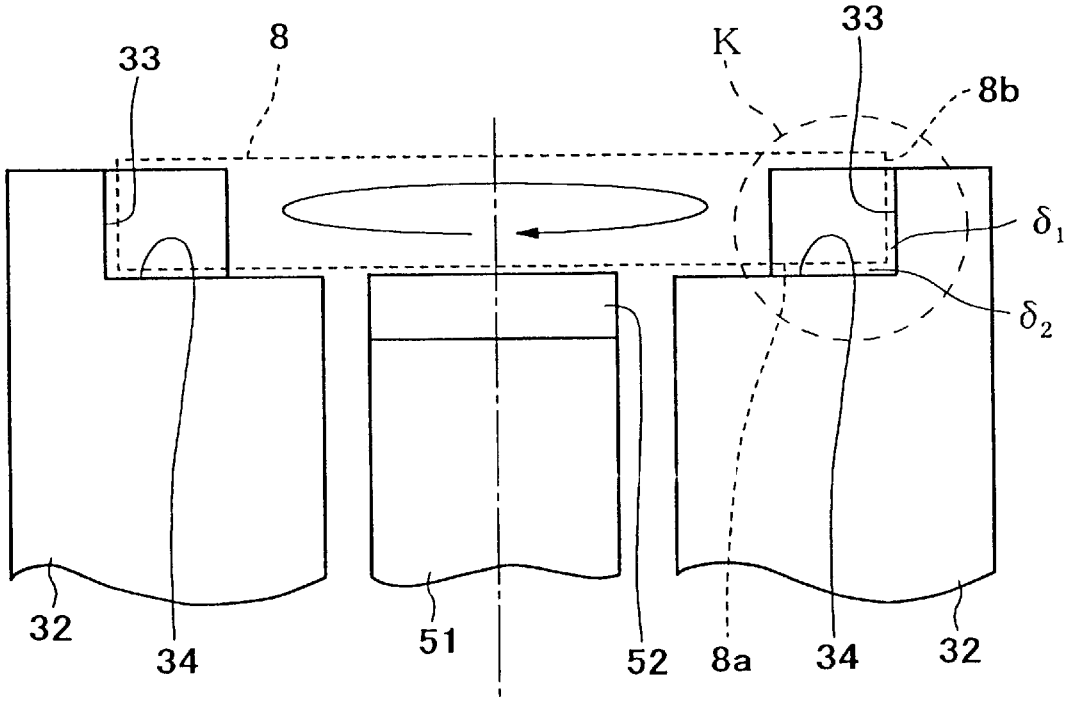
FIG. 8 is a view of the states of the polishing tool at the time of cleaning and correction.

Next, an explanation will be given of an example of the cleaning operation of the polishing tool in the polishing tool cleaning portion described above. After polishing the wafer W, the polishing tool 8 is, for example, in a state containing slurry SL or having solidified slurry SL and the impurities removed by polishing the wafer W, etc. deposited on it. In that state, the polishing tool 8 is rotated at a high speed. It is then raised in the Z-axial direction from the surface of the wafer W, then the X-axis table 55 is moved and the polishing tool cleaning portion 31 is positioned at a predetermined position beneath the polishing tool 8. Then, the polishing tool 8 is moved downward in the Z-axial direction, and, for example, as shown in FIG. 8, positioned at a position where a predetermined clearance $\delta 2$ is formed between the facing surface 34 of the cleaning member 32 of the polishing tool cleaning portion 31 and the polishing surface 8*a* of the polishing tool 8. In this state, a predetermined clearance $\delta 1$ is also formed between the outer circumferential surface 8*b* of the rotating polishing tool 8 and the facing surface 33 of the cleaning member 32.

Figure 9:
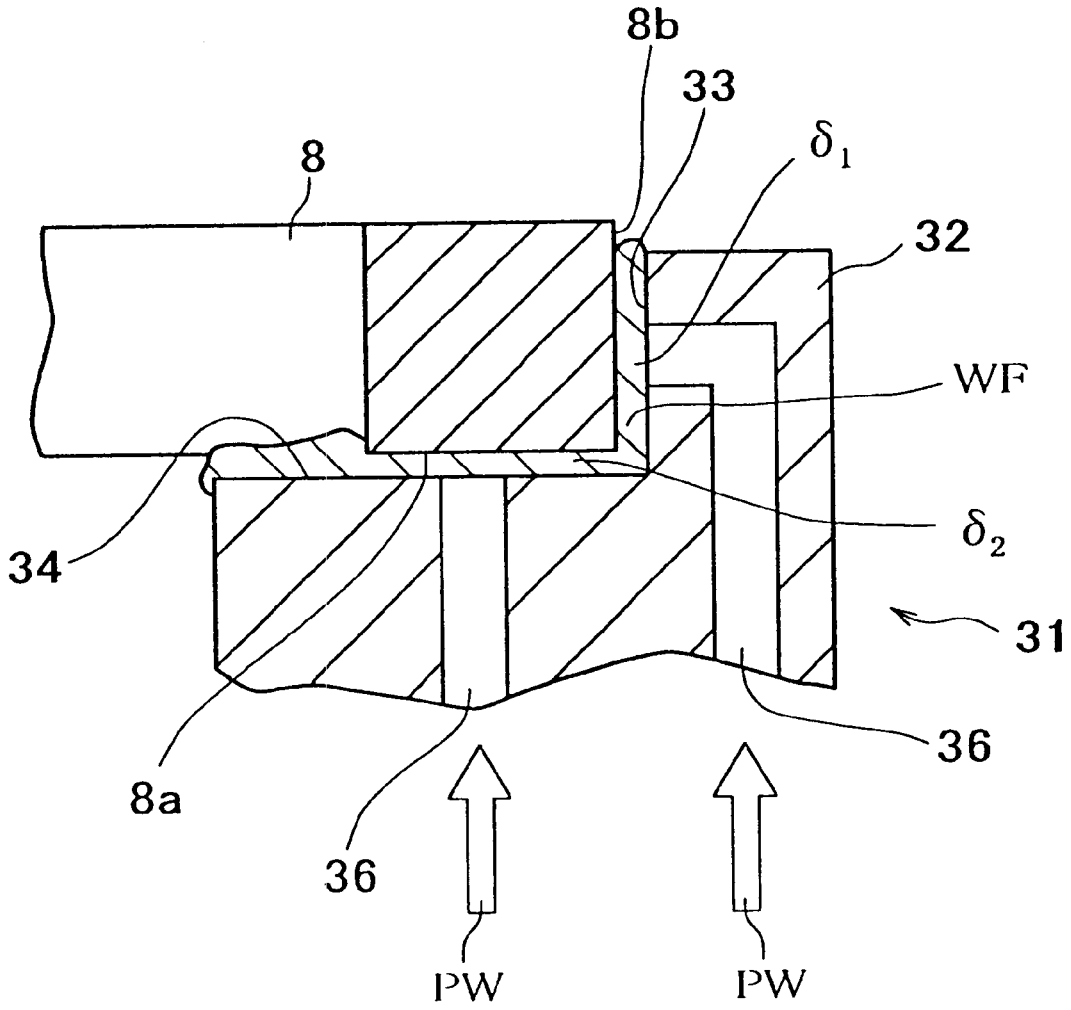
FIG. 9 is an enlarged sectional view of a portion in a circle K of FIG. 8.

In this state, pure water is fed from the cleaning solution feed ports 36 of the facing surfaces 34 and 33 of the cleaning member 32 to the clearances $\delta 1$ and $\delta 2$. Here, FIG. 9 is an enlarged sectional view of the portion inside the circle K of FIG. 8. As shown in FIG. 9, pure water PW is fed through the cleaning solution feed ports 36 to the clearances $\delta 1$ and $\delta 2$ formed between the polishing surface 8*a* and the outer circumferential surface 8*b* of the polishing tool 8 and the facing surfaces 34 and 33 of the cleaning member 32. At this time, since the surface tension of the pure water PW is relatively large and the clearances $\delta 1$ and $\delta 2$ are relatively small, pure water films WF are formed between the polishing surface 8*a* and the outer circumferential surface 8*b* of the polishing tool 8 and the facing surfaces 34 and 33 of the cleaning member 32. These pure water films WF are formed not over the entire surfaces, but partially on the polishing surface 8*a* and the outer circumferential surface 8*b* of the polishing tool 8.

Note that, in the present embodiment, the configuration was employed of feeding the pure water PW in the state of rotating the polishing tool 8, but it is also possible even if the polishing tool is not rotating at the time of discharge of the pure water PW. Further, the configuration was employed of positioning the polishing tool 8 in the polishing tool cleaning portion 31 in the state where the pure water PW is discharged from the cleaning solution feed ports 36 of the facing surfaces 34 and 33 of the cleaning member 32.

Upon formation of pure water films WF between the polishing surface 8*a* and the outer circumferential surface 8*b* of the polishing tool 8 and the facing surfaces 34 and 33 of the cleaning member 32, a shearing force acts due to the resistance between the polishing surface 8*a* and the outer circumferential surface 8*b* of the polishing tool 8 and the facing surfaces 34 and 33 of the cleaning member 32. This shearing force acting upon the pure water films WF is increased in comparison with a case of a smooth surface since the facing surfaces 34 and 33 of the cleaning member 32 are formed as rough faces.

Due to the action of the pure water films WF with this shearing force, the solidified slurry SL and impurities deposited on the polishing surface 8*a* and the outer circumferential surface 8*b* of the polishing tool 8 are flaked off and contained in the pure water films WF. Due to this action, the solidified slurry SL and impurities deposited on the polishing surface 8*a* and the outer circumferential surface 8*b* of the polishing tool 8 are removed with a high efficiency.

In the present embodiment, the facing surfaces 34 and 33 of the cleaning member 32 are not provided on the entire surfaces, but partially on the polishing surface 8*a* and the outer circumferential surface 8*b* of the polishing tool 8. Therefore, the pure water PW containing the solidified slurry SL and impurities which had stuck to the polishing surface 8*a* and the outer circumferential surface 8*b* of the polishing tool 8 flows down from a position where the facing surfaces 34 and 33 of the cleaning member 32 end, that is, an end of the cleaning member 32, that is, the ends of the facing surfaces 34 and 33 of the cleaning member 32 on a forward side of the rotation direction of the polishing tool 8 or the end portion on an inner circumferential side of the facing surface 34. For this reason, the solidified slurry SL and impurities in the pure water films WF will not again deposit on the polishing surface 8*a* and the outer circumferential surface 8*b* of the polishing tool 8.

On the other hand, the correction face of the correction tool 52 of the polishing tool correction device 51 contacts the polishing surface 8*a* of the polishing tool 8 and conditions the polishing surface 8*a* of the polishing tool 8. At this time, due to the correction of the polishing surface 8*a* of the polishing tool 8 by the correction tool 52, impurities comprised of the substance forming the polishing tool 8 and the substance forming the correction tool 52 are generated, but these impurities are flushed away by the pure water PW following the rotating polishing tool 8 and will not again deposit on the polishing surface 8*a* and the outer circumferential surface 8*b* of the polishing tool 8. The polishing tool 8 is cleaned as described above, the polishing surface 8*a* is corrected, and then the tool is used for the polishing of the wafer W.

By polishing the wafer W by the polishing tool 8 cleaned and corrected in the polishing surface 8*a* as described above, scratches in the polished face of the wafer W can be suppressed and the number of residual particles decreased, so the product yield is improved. As a result, the grain size, concentration, etc. of the polishing abrasive contained in the slurry SL can be precisely controlled, and therefore the polishing quality is greatly improved.

Further, according to the present embodiment, the polishing surface 8*a* of the polishing tool 8 is corrected, so good polishing can be stably carried out. Further, according to the present embodiment, the correction tool 52 for correcting the polishing tool 8 can be simultaneously cleaned, and therefore scratches in the polished face of the wafer W can be suppressed, the number of residual particles decreased, and the product yield improved.

As described above, according to the present embodiment, by forming the pure water films WF between the surface of the polishing tool 8 and the facing surfaces and causing a shearing force to act upon the pure water films WF by the rotation of the polishing tool 8, the substances deposited on the surface of the polishing tool 8 can be efficiently cleaned off by the action of the pure water films WF with the shearing force.

Further, according to the present embodiment, the facing surfaces of the cleaning member 32 are arranged at part of the surface of the surface of the polishing tool 8 to be cleaned, the polishing tool 8 is rotated to clean the entire surface of the cleaned surface, and the pure water PW serving as the cleaning solution containing the deposited substance flaked off from the surface of the polishing tool 8 therein is discharged from the clearances between the polishing tool 8 and the cleaning member 32. At the same time, fresh pure water PW is continuously fed to the clearances between the polishing tool 8 and the cleaning member 32. Therefore, the impurities will not deposit on the polishing tool 8 again, so the degree of cleanness of the surface of the polishing tool 8 is high.

Further, according to the present embodiment, the facing surfaces of the cleaning member 32 are arranged at part of the surface of the surface of the polishing tool 8 to be cleaned and the entire surface of the cleaned surface is cleaned by rotating the polishing tool 8. The clearances between the surface of the polishing tool 8 and the facing surfaces of the cleaning member 32 are relatively fine, and therefore efficient cleaning becomes possible by feeding a small amount of pure water PW.

It is advantageous from the viewpoint of polishing efficiency when, for example the polishing tool 8 formed from the independent foam member contains slurry SL contains polishing and an adequate amount of slurry is contained at the surface layer portion of the polishing tool 8, but in the present embodiment, the cleaning is not carried out by bringing a brush or the like in direct contact with the surface of the polishing tool 8. Only the surface of the polishing tool 8 is cleaned by the pure water PW, and therefore the slurry SL impregnated inside the polishing tool 8 is not also removed, but is held inside the polishing tool 8. Further, the brush or the like is not brought into direct contact with the surface of the polishing tool 8, so deformation and deterioration of the surface of the polishing tool 8 can be suppressed.

In the present embodiment, the polishing tool 8 is cleaned by pure water after polishing by the polishing tool 8, and therefore adhesion and solidification of slurry and other impurities deposited on the polishing tool 8 can be prevented. For this reason, the polishing tool 8 is free from deposits of adhered and solidified impurities and a sufficient cleaning effect is obtained even if the impurities are not directly physically scraped off by a means such as a brush.

Note that, in the present embodiment, the facing surface of the cleaning member 32 is not arranged with respect to the inner circumferential surface of the polishing tool 8, but also the inner circumferential surface of the polishing tool 8 can also be cleaned by arranging the curved facing surface in the same way as the outer circumferential surface with respect to the inner circumferential surface of the polishing tool 8.

In the present embodiment, an explanation was made of the case where the polishing surface 8*a* was also corrected together with the cleaning of the polishing tool 8, but it is also possible if the polishing surface 8*a* is not corrected, only the polishing tool 8 is cleaned, and then the wafer W is polished.

In the present embodiment, the configuration was employed of providing a plurality of cleaning solution feed ports 36 in both of the facing surfaces 34 and 33 of the cleaning member 32, but a configuration may also be employed of providing them in either one of the facing surfaces 34 and 33. When the plurality of cleaning solution feed ports 36 is provided in only one of the facing surfaces 34 and 33, the facing surfaces 34 and 33 continue from each other, the clearances between the polishing surface 8*a* and the outer circumferential surface 8*b* of the polishing tool 8 and the facing surfaces 34 and 33 are fine, and therefore it is possible to form the pure water films in both of the clearances between the polishing surface 8*a* and the outer circumferential surface 8*b* of the polishing tool 8 and the facing surfaces 34 and 33.

In the present embodiment, the configuration was employed of discharging the pure water PW fed to the clearances between the surface of the polishing tool 8 and the facing surfaces 34 and 33 of the cleaning member 32 from the end portions of the cleaning members 32 by arranging a plurality of cleaning members 32 along a circumferential direction of the polishing tool 8 with spaces, that is, discontinuously arranging them; but the present invention is not limited to this configuration.

In the present embodiment, the configuration was employed of feeding the cleaning solution from the cleaning solution feed ports 36 formed in the cleaning members 32 and opened in the facing surfaces 34 and 33 to the clearances between the surface of the polishing tool 8 and the facing surfaces 34 and 33, but it is also possible to employ a configuration providing, for example, a nozzle for feeding the cleaning solution separately from the cleaning member 32 and feeding the cleaning solution from the outside of the cleaning member 32 toward the clearances between the facing surfaces 34 and 33 and the surface of the polishing tool 8.

It is also possible to employ a constitution of feeding the cleaning solution from the cleaning solution feed ports 36 formed in the cleaning member 32 and opened in the facing surfaces 34 and 33 to the clearance between the surface of the polishing tool 8 and the facing surfaces 34 and 33 and, at the same time, providing a nozzle for feeding the cleaning solution separately from the cleaning members 32 and feeding the cleaning solution from the outside of the cleaning members 32 toward the clearances between the facing surfaces 34 and 33 and the surface of the polishing tool 8.

Figure 10:
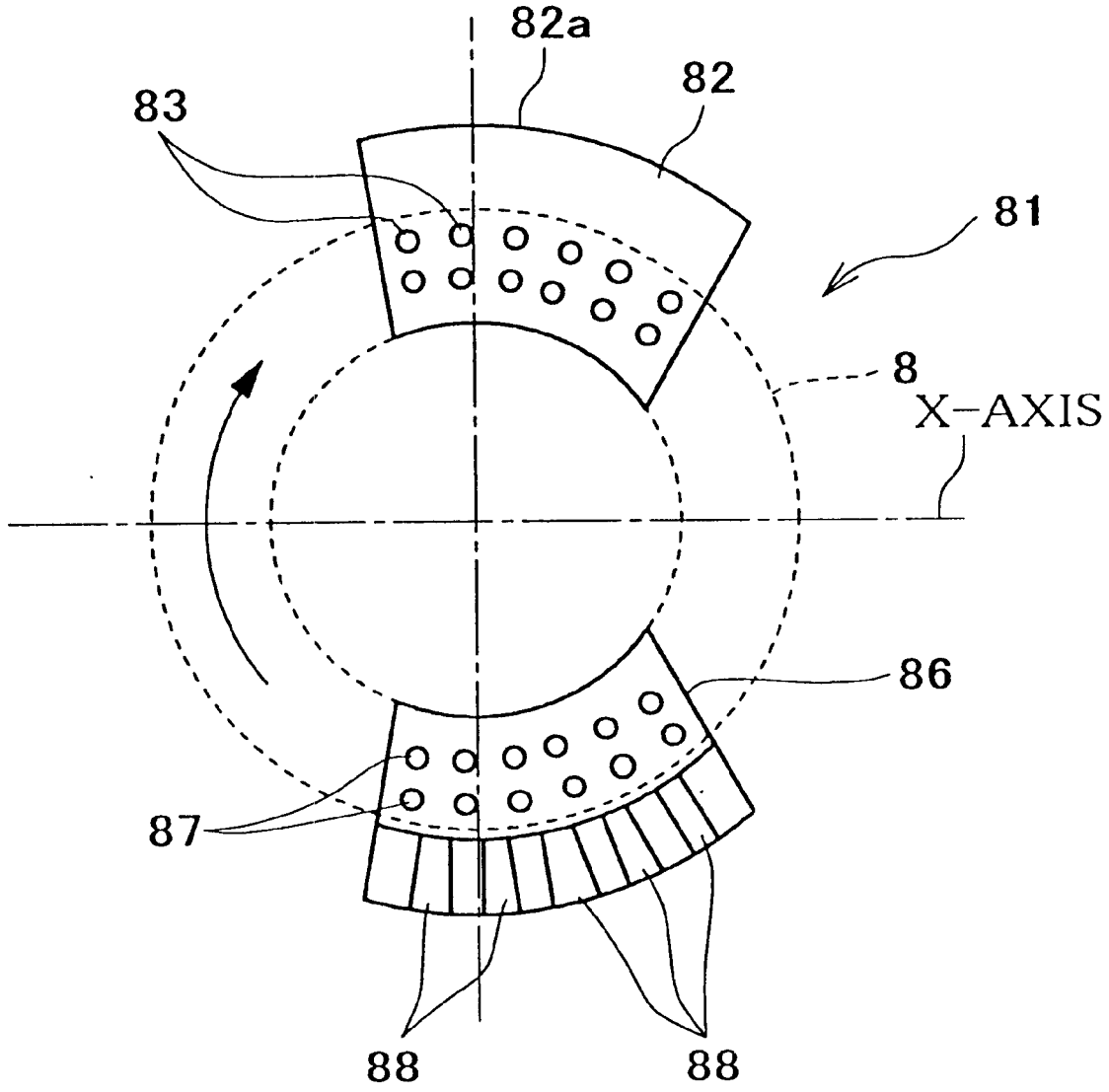
FIG. 10 is a top view of a cleaning member according to a modification of the present invention.
Figure 11:
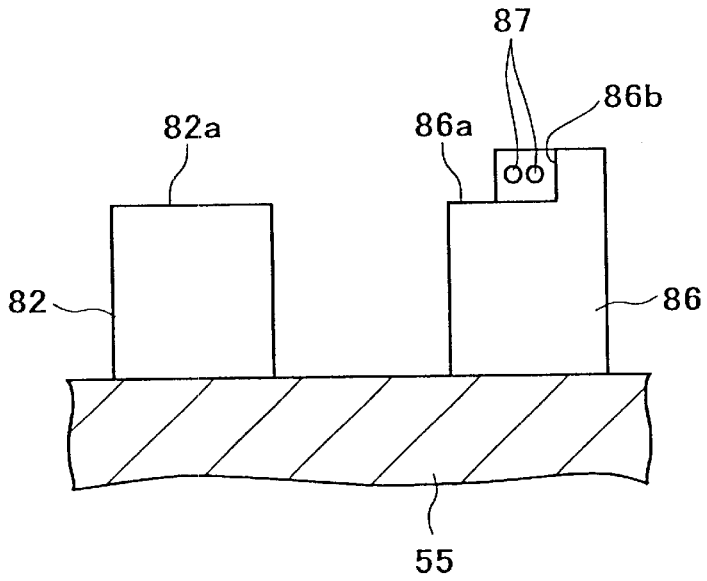
FIG. 11 is a side view of the cleaning member shown in FIG. 10.
Figure 12:
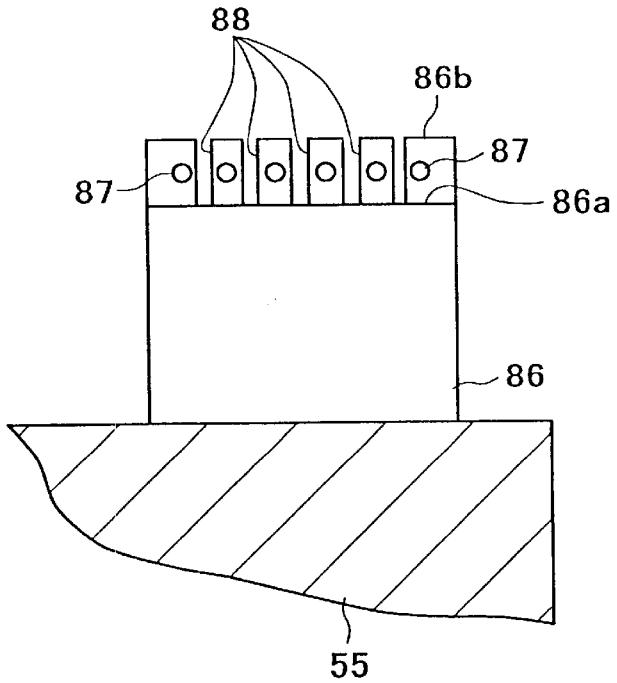
FIG. 12 is a view of one side of the cleaning member shown in FIG. 10.

As the function of discharging the pure water PW fed to the clearances between the surface of the polishing tool 8 and the facing surfaces 34 and 33 of the cleaning member 32, it is also possible to employ the configuration as shown in, for example, FIG. 10 to FIG. 12. FIG. 10 is a top view of another example of the cleaning member, FIG. 11 is a side view of the cleaning member shown in FIG. 10, and FIG. 12 is a side view of one cleaning member between two cleaning members shown in FIG. 10.

Between the two cleaning members 82 and 86 shown in FIG. 10 to FIG. 12, the cleaning member 82 is provided with only a facing surface 82*a* facing the polishing surface 8*a* of the polishing tool 8 and not provided with a facing surface facing the outer circumferential surface 8*b* of the polishing tool 8. Further, as shown in FIG. 10, the cleaning member 82 is provided with a plurality of cleaning solution feed ports 83 opened in the facing surface 82*a*. The cleaning solution, for example, pure water, is discharged from the cleaning solution feed ports 83. The cleaning member 86 is provided with a facing surface 86*a* facing the polishing surface 8*a* of the polishing tool 8 and a facing surface 86*b* facing the outer circumferential surface 8*b* of the polishing tool 8. Further, the cleaning member 86 is provided with a plurality of cleaning solution feed ports 87 opened in the facing surface 86*a* and the facing surface 86*b*. The cleaning solution, for example, pure water, is discharged from the cleaning solution feed ports 87. Further, a recess portion 88 is formed in a wall portion forming the facing surface 86*b* of the cleaning member 86, except the portion for forming the cleaning solution feed 23 ports 87. The cleaning member 82 is not provided with the facing surface facing the outer circumferential surface 8*b* of the polishing tool 8, so it cannot clean the outer circumferential surface 8*b* of the polishing tool 8, but the discharge of the cleaning solution fed to the clearance between the polishing surface 8*a* and the facing surface 82*a* becomes easy. The cleaning member 86 can clean both the polishing surface 8*a* and the outer circumferential surface 8*b* of the polishing tool 8, and the cleaning solution fed to the clearance between the outer circumferential surface 8*b* of the polishing tool 8 and the facing surface 86*a* is discharged to the outside also from the recess portion 88, and therefore it becomes easy to discharge the cleaning solution fed to the clearance between the outer circumferential surface 8*b* of the polishing tool 8 and the facing surface 86*b* of the cleaning member 86 to the outside.

As described above, according to the present invention, the scratching of the polished face of the polished object and the number of residual particles are reduced and thus the product yield can be improved. Further, according to the present invention, together with the cleaning of the polishing tool, the correction tool can be simultaneously cleaned. Therefore the scratching of the polished face of the polished object and the number of residual particles are reduced, so the product yield can be improved. Further, the correction tool can be cleaned as a byproduct of the cleaning of the polishing tool, so the cost merit is also high.

While the invention has been described with reference to a specific embodiment chosen for the purpose of illustration, it should be apparent that numerous modifications could be made thereto by those skilled in the art without departing from the basic concept and scope of the invention.

In the claims:

1. A cleaning method of a polishing tool for cleaning a rotatably held polishing tool having a polishing surface to be cleaned and an outer peripheral surface extending perpendicularly to the polishing surface, the cleaning method comprising:

arranging with respect to the polishing tool a cleaning member having a first facing surface facing the polishing surface of said polishing tool to be cleaned forming a first clearance with and between the polishing surface and a second facing surface facing the outer peripheral surface of said polishing tool forming a second clearance with and between the outer peripheral surface, feeding a cleaning solution to the first clearance to form a first cleaning solution film between the first facing surface and the polishing surface and to the second clearance to form a second cleaning solution film between the second facing surface and the outer peripheral surface, and rotating the polishing tool to clean at least the polishing surface of said polishing tool.

2. A cleaning method as set forth in claim 1, wherein the first facing surface partially faces the polishing surface of the polishing tool and further comprising cleaning the entire surface of the polishing surface of said polishing tool by movement of the polishing surface of the polishing tool with respect to the first facing surface of the cleaning member.

3. A cleaning method as set forth in claim 1, wherein said polishing tool comprises a cylindrical member having the polishing surface at one end in the direction of the rotation axis and further comprising arranging with respect to said polishing tool a cleaning member having the first facing surface with a flat surface facing the polishing surface of said polishing tool and the second facing surface with a curved surface facing the outer peripheral surface of said polishing tool formed circumferentially and cleaning the polishing surface and the outer peripheral surface of said polishing tool using the same.

4. A cleaning method as set forth in claim 3, further comprising arranging a plurality of said cleaning members at positions spaced apart in the circumferential direction of said polishing tool and cleaning said polishing tool using the same.

5. A cleaning method as set forth in claim 1, further comprising feeding said cleaning solution into said the first and second clearances through feed ports formed in said cleaning member and opening to said first and second facing surfaces.

6. A cleaning method as set forth in claim 1, further comprising using pure water as said cleaning solution.

7. A cleaning method as set forth in claim 1, further comprises using said polishing tool for polishing by making the polishing surface of said rotating polishing tool face a polished surface of a rotating polished object, interposing a polishing agent between said polished surface and said polishing surface, and making said polished object and said polishing tool move relatively along a predetermined plane in that state to flatten the polished object.

8. A cleaning method of a polishing tool for cleaning a rotatably held polishing tool having a polishing surface to be cleaned and an outer peripheral surface extending perpendicularly to the polishing surface, the cleaning method, comprising:

positioning a correction tool for correcting a polishing surface of the polishing tool at a position enabling contact with the polishing surface of the polishing tool, positioning a cleaning member having a first facing surface facing at least part of the polishing surface of the polishing tool for forming a first clearance with and between the at least part of the polishing surface and a second facing surface facing the outer peripheral surface of said polishing tool forming a second clearance with and between the outer peripheral surface, feeding a cleaning solution to the first clearance to form a first cleaning solution film between the first facing surface and the polishing surface and to the second clearance to form a second cleaning solution film between the second facing surface and the outer peripheral surface, and rotating the polishing tool to correct the polishing surface while cleaning at least the polishing surface.

9. A cleaning method as set forth in claim 8, wherein said correction tool has a correction surface contacting the polishing surface of the polishing tool and further comprising cleaning the correction surface of said correction tool by the cleaning solution deposited on the polishing surface of the polishing tool.

10. A polishing method for flattening a polished object by making a polishing surface of a rotating polishing tool face a polished surface of a rotating polished object and relatively moving the polished object and the polishing tool along a predetermined plane, the polishing tool having a polishing surface to be cleaned and an outer peripheral surface extending perpendicularly to the polishing surface, the polishing method comprising:

positioning the polishing tool at a predetermined position with respect to a cleaning member provided with a first facing surface for forming a first clearance with the polishing surface of the polishing tool and a second facing surface for forming a second clearance with the outer peripheral surface, feeding a cleaning solution to the first clearance formed between the first facing surface and the polishing surface and to the second clearance formed between the second facing surface and the outer peripheral surface to form a cleaning solution film, rotating the polishing tool to clean at least the polishing surface and polishing the polished object by using the cleaned polishing surface.

11. A polishing method as set forth in claim 10, further comprising:

interposing a polishing agent between said polished surface and said polishing surface when polishing the polished object and cleaning a polishing tool in a state containing said polishing agent.

12. A polishing method as set forth in claim 11, further comprising using a tool formed from an independent foam member as said polishing tool.

13. A polishing apparatus comprising:

a polishing means for flattening a polished object by a rotating polishing tool having a polishing surface to be cleaned and an outer peripheral surface extending perpendicularly to the polishing surface and a polishing tool cleaning means for cleaning at least the polishing surface of the polishing tool, wherein the polishing tool cleaning means has a cleaning member having a first facing surface facing the polishing surface of the polishing tool forming a first clearance between the first facing surface and the polishing surface forming a first film of a cleaning solution with and between the first facing surface and the polishing surface of the rotating polishing tool and a second facing surface facing the outer peripheral surface of the polishing tool forming a second clearance between the second facing surface and the outer peripheral surface a forming a second film of the cleaning solution with and between the second facing surface and the outer peripheral surface of the rotating polishing tool and a cleaning solution feeding means for feeding the cleaning solution to the first clearance and the second clearance.

14. A polishing apparatus as set forth in claim 13, wherein said polishing means makes the polishing surface of the rotating polishing tool face the polished surface of the polished object and makes the polished object and the polishing tool move relatively along a predetermined plane to flatten the polished object.

15. A polishing apparatus as set forth in claim 14, wherein said polishing means comprises a polishing agent feeding means for feeding a polishing agent to be interposed between the polished surface of the polished object and the polishing surface of the polishing tool.

16. A polishing apparatus as set forth in claim 13, wherein said polishing tool comprises a cylindrical member having the polishing surface at one end in the direction of the rotation axis and said first facing surface is provided with a flat facing surface facing the polishing surface of said polishing tool and the second facing surface has at least one curved facing surface facing the outer peripheral surface of said polishing tool.

17. A polishing apparatus as set forth in claim 16, wherein said flat facing surface and curved facing surface of said cleaning member are continuous from each other.

18. A polishing apparatus as set forth in claim 16, wherein a plurality of said cleaning members are arranged along the circumferential direction of said polishing tool at spaces from each other.

19. A polishing apparatus as set forth in claim 13, further comprising a moving means for moving and relatively positioning said polishing tool with respect to said cleaning means.

20. A polishing apparatus as set forth in claim 19, wherein said moving means comprises:

a horizontal direction moving means for making said polished object move relatively with respect to said polishing tool along said predetermined plane and a facing direction moving means for making said polishing tool move relatively in a direction facing said polished object.

21. A polishing apparatus as set forth in claim 13, wherein said cleaning solution feeding means comprises:

a plurality of cleaning solution feeding ports with at least one port formed in said first facing member and opening to feed said cleaning solution to the first clearance and with at least another port formed in said second facing member and opening to feed said cleaning solution to the second clearance and a cleaning solution feeder for feeding a cleaning solution to the first clearance and the second clearance through said plurality of cleaning solution feed ports.

22. A polishing apparatus as set forth in claim 13, further comprising a polishing tool correcting means capable of correcting the polishing surface of the polishing tool with the cleaning of the polishing tool.

23. A polishing apparatus as set forth in claim 22, wherein said polishing tool correcting means comprises a correction tool arranged to be able to contact the polishing surface of a rotating polishing tool in an area where said cleaning member is not arranged.

24. A polishing apparatus as set forth in claim 13, wherein the first facing surface of said cleaning member is formed as a rough surface.

25. A polishing apparatus as set forth in claim 13, wherein said polishing tool is formed from an independent foam member.

26. A polishing apparatus as set forth in claim 13, wherein said cleaning solution is pure water.

* * * * *